United States Patent [19]

Forest et al.

[11] 4,344,070

[45] Aug. 10, 1982

[54] PERMANENT MAGNET FOR A BISTABLE ELEMENT AND BISTABLE ELEMENT AND DATA DISPLAY UNITS WITH AT LEAST ONE SUCH ELEMENT

[76] Inventors: Jean-Pierre Forest, Chemin Ste. Barbe, 59126 Linselles; Jean Y. Rabette, 4 Allee du cloitre, 59910 Bondues, both of France

[21] Appl. No.: 163,402

[22] Filed: Jun. 26, 1980

[51] Int. Cl.[3] ..... G08B 5/14

[52] U.S. Cl. ..... 340/815.08; 340/764

[58] Field of Search ..... 340/806, 809, 373, 378.5, 340/764, 783

[56] References Cited

U.S. PATENT DOCUMENTS

| | | | |
|---|---|---|---|
| 3,260,871 | 7/1966 | Lang | 340/378.5 X |
| 3,267,455 | 8/1966 | McGuire et al. | 340/764 |
| 3,470,509 | 9/1969 | Silverman et al. | 340/378.5 X |
| 3,636,557 | 1/1972 | Watkins | 340/378.5 |

*Primary Examiner*—David L. Trafton

*Attorney, Agent, or Firm*—Kerkam, Stowell, Kondracki & Clarke

[57] ABSTRACT

The invention relates to a permanent magnet.

Seen in profile, said permanent magnet 6, which has its North and South poles N 6, S 6 along one and the same line 7 radial to its axis of rotation 4, has contours 21, 22 on the areas 23, 24 which carry said poles; the contours being, with respect to the axis of rotation 4:

on the one hand, diametrically opposed; and on the other hand, situated at different distances from said axis 4, the fractions 23*a*, 24*a* on the one hand, and 23*b*, 24*b* on the other hand, of said zones being distanced differently depending on whether they are to one side or the other of the aforementioned radial line 7.

Application to bistable elements and to data display units consisting in at least one such bistable element.

7 Claims, 8 Drawing Figures

Figure 1:
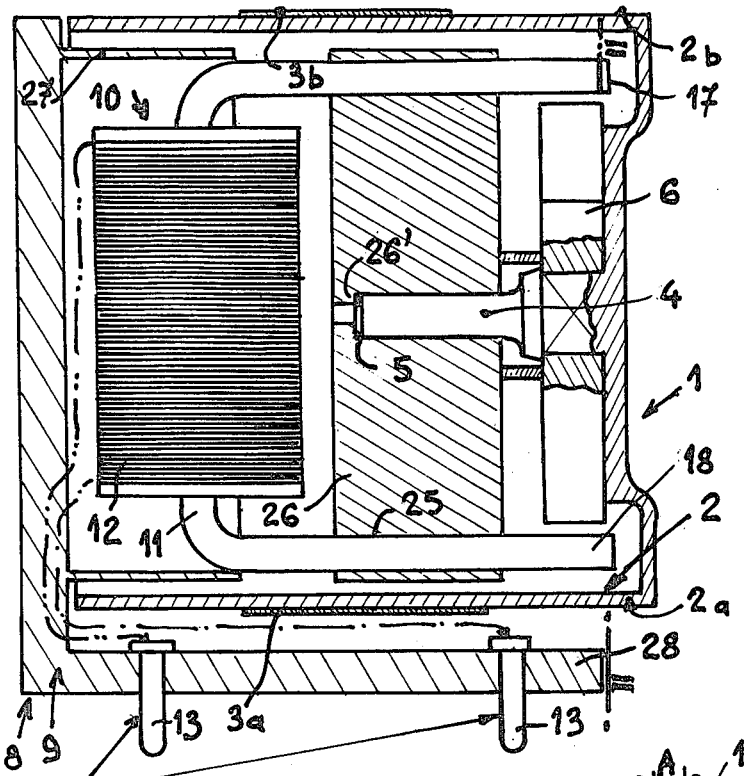

PERMANENT MAGNET FOR A BISTABLE ELEMENT AND BISTABLE ELEMENT AND DATA DISPLAY UNITS WITH AT LEAST ONE SUCH ELEMENT

The invention relates to a permanent magnet for a bistable element activated by magnetic means as well as such elements and data display units provided with at least one unit.

In such a bistable element, data display is accomplished by means of a rotor made up of a cylindrical body (U.S. Pat. No. 2,740,955), spherical body (U.S. Pat. No. 3,036,300) or even flat body (U.S. Pat. No. 1,191,023) on one of whose surfaces—which for each body form listed above are the halves of the lateral surface, the hemispherical surfaces, or the opposite sides, respectively—are found, in at least one area, an indication differing from the one provided by the other surface.

For example, these different indications could be conventional fields of color, such as white or yellow on the one hand and black on the other hand.

Depending on which surface is visible, the body in question makes it possible to provide an indication which is either sufficient unto itself (U.S. Pat. Nos. 2,415,452 and 2,740,955) or, in combination with other elements, contributes to making up a more complicated sign, such as the formation of letters or numbers (U.S. Pat. Nos. 1,191,023, 1,799,731 and 3,036,300). These characters then make it possible, among other applications, to compose display panels showing schedules, train or airplane times, sports results, etc.

As indicated above, in order to orient each rotor of a bistable element correctly, it is possible to induce 180° rotation around its axis by magnetic means.

Such magnetic means are described in the patents noted above and in numerous other documents, for example in U.S. Pat. No. 3,025,512 in which, exclusive of the rotor, these means include:

- a permanent magnet which interlocks in rotation with the rotor it is attached to in a position such that the axes passing through the NORTH and SOUTH poles of the permanent magnet are basically radial to the axis of rotation of the motor;
- a stator constituting the support for the following component;
- an electromagnet attached to the stator and in a position such that its North and South poles lie both more or less symetrically to the axis of the rotation of the rotor and in the plane in which, in conjunction with said rotor, the poles of the rotor's permanent magnet turn;
- a device for mobile connection of the electromagnet to a direct current source with reversible polarity.

It is known that:

on the one hand, two magnets placed in the presence of one another combine to exercise forces of attraction between their ends with different polarities and repulsion between their ends with the same polarities; and on the other hand, reversing the polarity of the direct current feeding the electromagnet results in a reversal of the magnetic field of that electromagnet.

Thus it can be seen that, depending on the magnetic field created by the electromagnet of the stator, the permanent magnet and consequently the rotor are:

- either held in place if the permanent magnet was properly oriented;
- or caused to rotate 180° so that the permanent magnet assumes the proper position.

The current feed to the electromagnet can be switched off immediately because, the bars making up the North-South poles of the electromagnet, even if they no longer have any remanent magnetism, are made of magnetic material and therefore would still attract the poles of the permanent magnet, thus keeping the rotor stabilized in the position determined by the latest command.

The principle of operation of such a bistable element is thus quite simple.

But there would be a problem, however, if before a rotation command was given the rotor was fixed in a position where the axis passing through the North-South poles of its permanent magnet was perfectly in line with the axis through the North and South poles of the electromagnet.

In such a case, the forces of repulsion would then produce no rotational torque, and instead would offset each other.

In order to overcome this problem when using magnetic activating methods, one known approach is to use other devices which intervene so that between commands, the North-South axes of the electromagnet and of the permanent magnet are alway out of line with respect to one another.

Among these other devices principally are found mechanical stops generally limiting the angle of the rotor's pivoting with respect to the stator to less than 180° (U.S. Pat. No. 3,025,512), which obviously, in the event of a cylindrical or spherical body, reduces the surface area usable for display purposes or, in the case of a flat body, tilts the display surfaces, and tilts them at a different angle depending upon which surface is exposed to view; this, in at least one of the positions, might negatively affect visibility.

In some variants which exist, some of which make it possible to continue having complete 180° pivoting, the action of these mechanical stops is combined with the action of a magnetic field created by a supplementary permanent magnet mounted on the stator (U.S. Pat. Nos. 2,740,955 and 3,518,661) and/or the action resulting from a characteristic positioning of the permanent magnet of the rotor, wherein this permanent magnet, when the rotor is stabilized, may have the axis of North-South poles which, in relation to the axis of the poles of the electromagnet, is offset in parallel (U.S. Pat. No. 2,740,955) or is tilted (U.S. Pat. No. 3,624,941). With all these other methods, the distance of the poles of the electromagnet from those of the permanent magnet decreases the level of magnetic attraction in the resting state and therefore has a negative effect on the stability of the rotor between commands. Furthermore, by virtue of these mechanical methods and/or magnetic methods other than those essential for the activation of the rotor, such a bistable element is both complex and, especially, bulky and relatively expensive.

These defects are all the more serious as the element in question is used rarely but, generally at least, in large quantities.

For example, to make up only one changeable character, there are systems currently in use which involve thirty-five of these elements in five vertical rows of seven elements each.

Hence one result which is a goal of the invention is a permanent magnet for a bistable element of the type referred to above which, in order that its rotor not become stabilized in positions where the axes of the permanent magnet of the rotor and of the electromagnet of the stator would not be in an unsatisfactory position relative to each other, uses no means other than those which are essential for activating the rotor, yielding an element which accordingly is simple, not bulky and inexpensive to manufacture.

One other result of this invention is such a bistable rotor whose rotations may be 180° exactly, said rotations always taking place in the same direction.

A further result of the invention is such an element whose methods of activation involve high torque at a low level of power consumption and are fully protected from blows and dust and from interference stemming from outside magnetic fields.

Also a result of the invention is an element which is very stable in the resting state, even in gusty winds.

To accomplish this, the object of the invention is a permanent magnet for a bistable element of the type referred to above which, when seen in profile, has its North and South poles on the same radial line to the axis of rotation and has over those areas where said poles are located has contours which, in relation to said axis of rotation:

on the one hand, are diametrically opposed; and on the other hand, situate fractions of the aforementioned areas at different distances from that axis depending on whether they are on one side or the other of the radial line.

Another object of the invention is these bistable elements and data display units consisting of at least one such element.

The following description, provided as a nonlimitative example and with reference to the attached drawings, will help make the invention easier to understand. The drawings are schematic representations of the following:

FIG. 1. An element seen in cross section through the axis of rotation of the rotor.

Figure 2:
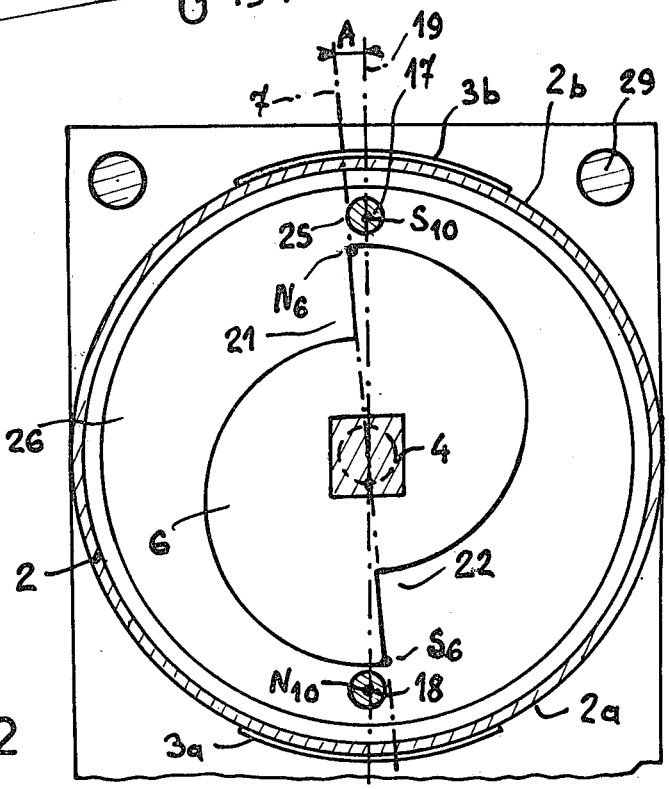

FIG. 2. The element seen in cross section along II—II in FIG. 1.

Figure 3:
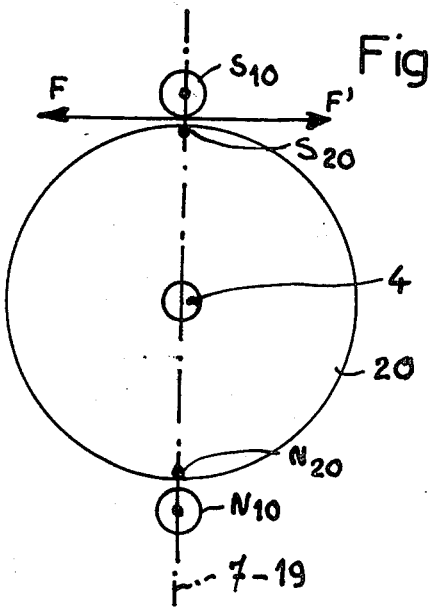

FIG. 3. A permanent magnet of a known type.

Figure 4:
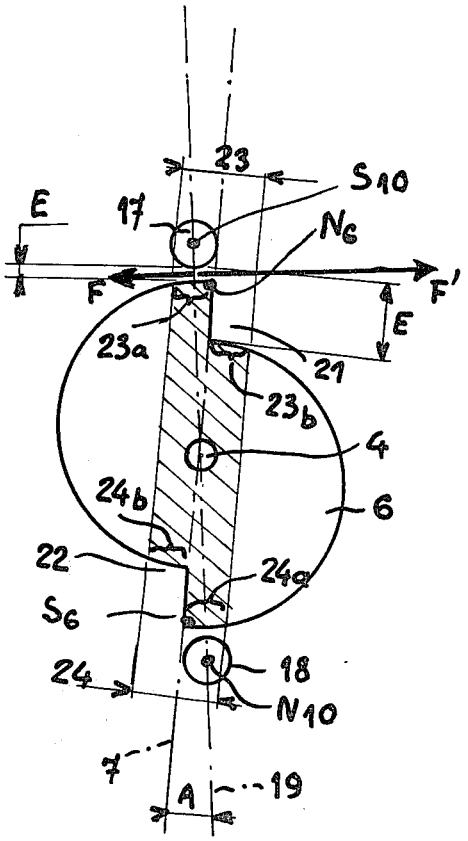

FIG. 4. A permanent magnet according to the invention.

Figure 5:
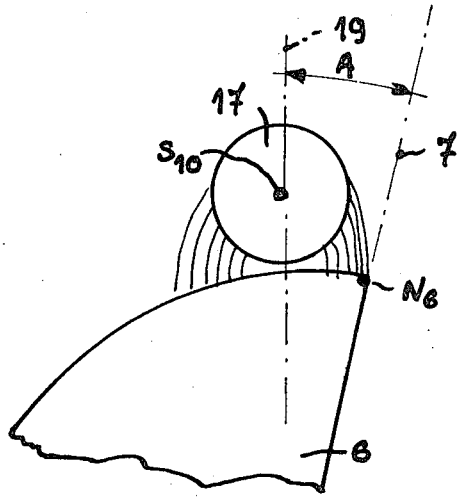

FIG. 5. A large scale view of detail from FIG. 4.

Figure 6:
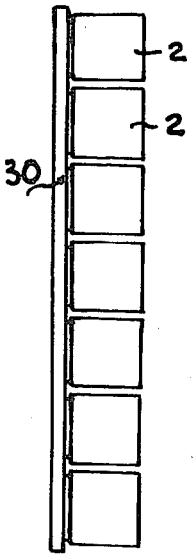

FIG. 6. A row of elements making up a display unit.

Figure 7:
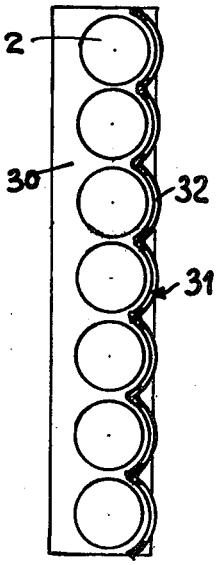

FIG. 7. Schematically, such a unit seen in profile.

Figure 8:
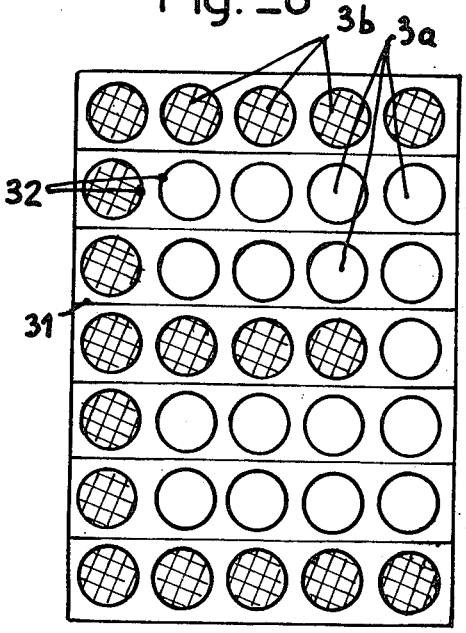

FIG. 8. Schematically, the front surface of such a unit.

With reference to FIGS. 1 and 2, it can be seen that the element in question includes a rotor 1 formed by a cylindrical body 2 which has, on its lateral surface and in a known manner, two diametrically opposed zones 2*a* and 2*b* with different indications 3*a* and 3*b*, such as one reflectorized yellow patch 3*a* and one flat black patch 3*b*.

The rotor 1 is borne on an axis 4 which rotates freely within a bearing 5 which guides its rotation as well as stops its movement in at least one direction as will be explained below.

To properly orient the rotor so that the indications 3*a* and 3*b* which are suited for the time being are visible, the rotor is caused to rotate by magnetic means including:

a permanent magnet 6 rotating of a piece with the rotor 1 to which it is attached in such a way that the axis 7, passing through its North N 6 and South S 6 poles, is radial to the axis of rotation of the rotor;

a stator 8 made up of one support 9 for an electromagnet 10;

the aforementioned electromagnet, attached to the stator, and consisting of a bar 11 of magnetic material bent into a U shape and a winding 12 connected with two connecting studs 13;

a connecting circuit 14 for the studs 13, tying them into a direct current source 15 through a reversing switch 16 allowing for short-term and reversible feeding of the winding 12.

The bar 11 may thus be temporarily magnetized in the sense selected and the end of each of its branches 17, 18, thus alternately giving them a North pole N 10 and South pole S 10.

The branches 17, 18 of the bar 11 are arranged both in parallel and symetrically with respect to the axis 4, and their free ends are well within the plane within which the poles N 6, S 6 of the permanent magnet 6 turn.

If the current feed is such that the poles opposite one another of the permanent magnet 6 and the electromagnet 10 are of opposite polarity (FIG. 2), the reciprocal forces of attraction which result cause the permanent magnet to remain where it is. On the other hand, if the poles in question are of the same polarity, repulsive forces develop which, if they are not offsetting, bring about a 180° rotation of the permanent magnet 6 until the conditions described above are achieved.

After the current feed to the winding is switched off, because of the remanent magnetism of the bar 11 or simply because its branches 17, 18 are of a magnetic material, the poles of the permanent magnet 6 are maintained near the branches 17, 18 and thus retain the last position induced.

We shall now describe how, in accordance with the invention and without any other mechanical and/or magnetic means, the rotor 1 is kept from becoming stabilized in a position where the radial line 7 through the poles of the permanent magnet 6 would be exactly the same as the one 19 through the poles of the electromagnet 10.

That situation, which would be possible with a permanent magnet of a known type, would result in a situation where, when the current is reversed (FIG. 3), there would be a balancing of the repulsion forces F and F' which would not allow the permanent magnet 20 to rotate.

It is therefore quite necessary that in the resting position the two lines 7 and 19 be out of phase by a given angle A.

In accordance with one essential trait of the invention, this result is obtained by abrupt and sudden contours or cuts 21,22 (FIG. 4) in the permanent magnet 6, this in areas 23, 24 which have the poles, and by the fact that these cuts, in relation to the axis of rotation 4, are diametrically opposed and located at different distances from the fractions of areas 23*a*, 24*a*, on the one hand and 23*b*, 24*b* on the other hand, delimited by radial line 7.

This result is attributable to the fact that in any magnetic attraction between two bodies, the stable position toward which the system tends is the one corresponding to the maximum flux.

In fact, the flux, and hence the magnetic force, increases as the clearance E decreases; on the assumption that lines 7 and 19 are initially in line, the areas 23*a*, 24*a* would be subjected to greater forces of attraction than those affecting fractions 23*b*, 24*b*, and the difference would therefore create a rotational torque existing until the forces acting are in balance (see lines of force in FIG. 5).

The angle A of being out of phase is proportional to the size of the cut and to the size of the branches of the electromagnet 10.

On the other hand, the permanent magnet 6 may have any shape whatsoever, such as, for example, the one represented by a heavy line in FIG. 4 or the one represented by fine dashes and the cross-hatching also in FIG. 4.

As the cut does not modify the actual position of the poles of the permanent magnet, when the magnetic field is reversed in the electromagnet 10, the situation is the same as if the permanent magnet had been tilted by mechanical and/or magnetic means.

Accordingly, every time the current changes, forces F and F' are unequal and the rotor therefore pivots, this always in the same direction, namely toward the cut out side, which distinguishes it from other known bistable elements which always pivot a maximum of 180° and alternately in one direction and then the other.

It is quite obvious that, without going outside the scope of the invention, this permanent magnet may be used to fit out a bistable element in which the rotor body could be of any shape, such as cylindrical, spherical or flat.

In one preferred method of manufacture, if only because of its lack of sensitivity to the wind, the body of the rotor is cylindrical or slightly arched and, in accordance with one of the invention's characteristics, completely covers the electromagnet 10 and the permanent magnet, first to protect them from shocks, duct, and the effects of outside magnetic fields, and second, to provide the largest possible surface area for the indications to be displayed.

In accordance with another characteristic, the bearing 5 for the rotational axis of the rotor and hence for the permanent magnet 6 is precisely positioned with respect to the branches 17, 18 of the electromagnet, this by inserting said branches in holes 25 drilled in the ring 26 making up the bearing 5. Consequently, clearance E may be reduced to the lowest possible value, permitting the obtaining of high rotational torque at very low levels of power consumption.

The axis of rotation 4, part of the rotor, may be anchored or simply placed in the bearing 5 until it butts against the end 26 bearing 5 in ring 26, this without there being any need to provide for a retaining device. In fact, by virtue of the law of maximum flux referred to above, the permanent magnet will be drawn toward the inside of the branches of the electromagnet and will not be able to escape.

The support 9 for the electromagnet 10 is formed by a radial plate which is the fictive extension of the axis of rotation 4, and against which the end of the rotor with the cylindrical overhang nearly abuts, thereby improving airtightness.

The plate may also feature a small collar 27 or ring capped by the body of the rotor in order to guide the rotor or simply constituting a protective baffle.

For greater stability, the plate also has a base 28 providing proper seating for the entire bistable element and/or studs 29 which will form positioning shims by pressing against similar elements or other stops.

For the same reason, when constructing visual display units made up of several rows of elements, the elements in the same row or in the same unit could be supported by a single support 30.

For further protection of the bistable elements, in front of the visual display unit could be a mask 31 which has, opposite each body 2, cutouts 32 in the shape of the character or letter to be shown, for example circular ones, which then makes it possible to mount colored fields *3a*, *3b* with larger surfaces and in different shapes.

We claim:

1. Permanent magnet (6) for bistable element (1+8) activated by magnetic means (10) and constituting one of the components of a data display unit (2+30+31); said element (1+8) comprising:

a rotor, (1) a body (2) for said rotor on the outside of which are delimited two opposite surfaces (*2a+2b*) which bear different indications (*3a+3b*) from each other;

a permanent magnet (6) rotating with the body (2) of the rotor (1) and to which it is attached in a position such that a line (7) passing through North and South poles of the permanent magnet is radial to an axis of rotation (4) of the rotor (1);

a stator (8) having a support (9);

an electromagnet (10) attached to said support (9) in such a position that its North and South poles are simultaneously and substantially symmetrically arranged with respect to the axis of rotation (4) of the rotor (1) and in a plane in which the poles of the permanent magnet (6) revolve around the axis (4) of the rotor;

means for connecting the electromagnet (10) to a direct current source for short-term feeds with reversible polarity;

said permanent magnet (6) comprising:

when seen in profile, polar zones having abruptly cut away contours such that they delimit, in each of said zones, very precisely on one side and the other of the line (7) passing through the poles of the permanent magnet, fractions of polar areas whose respective distances from the axis (4) of rotation of the permanent magnet (6) are different; and diametrically opposed to the axis (4) one of the fractions of each of the polar zones, because of the contouring, is closest to the axis (4) and the other of the fractions is farthest away.

2. Bistable element for the display of data, including:

a rotor (1), a body (2) for said rotor on the outside of which are delimited two opposite surfaces (*2a+2b*) which bear different indications (*3a+3b*) from each other;

a permanent magnet (6) rotating with the body (2) of the rotor (1) and to which the permanent magnet is attached in a position such that a line (7) passing through North and South poles of the permanent magnet is radial to an axis of rotation (4) of the rotor (1);

a stator (8), a support (9) for the stator;

an electromagnet (10) attached to that support (9) in such a position that its North and South poles are simultaneously substantially symmetrically arranged with respect to the axis of rotation (4) of the rotor (1) and in a plane in which the poles of the permanent magnet (6) revolve around the axis (4) of the rotor;

means for connecting the electromagnet (10) to a direct current source (15) for short-term feeds with reversible polarity;

said bistable element (48) in particular including a permanent magnet (6), comprising, when seen in profile, polar zones having abruptly cut away contours such that they delimit, in each of said zones, very precisely on one side and the other of the line (7) passing through the poles of the permanent magnet, fractions of polar areas whose respective distances from the axis (4) of rotation of the permanent magnet (6) are different; and diametrically opposed to the axis (4) one of the fractions of each of the polar zones, because of the contouring, is closest to the axis (4) and the other of the fractions is farthest away.

3. Bistable element according to claim 2 wherein said support (9) is a radial plate constituting a fictive extension of the axis (4) of rotation and contiguous with an end of the body (2) of the rotor (1).

4. Bistable element according to claim 3, wherein said radial plate includes a base (28).

5. Data display unit including at least one bistable element (1+8) according to any of claims 2 to 4.

6. Data display unit according to claim 5 which includes, on a front surface, a mask (31), cutouts (32) in said mask situated each across from the body (2) of a bistable element.

7. Data display unit according to claim 6 wherein the cutouts (32) of the mark each have a shape which delimits the shape of the indication caused to appear on the unit from the surface (2*a*+2*b*) of the body (2) of the bistable element.

* * * * *